US009945549B2

(12) United States Patent
Sukhanov et al.

(10) Patent No.: US 9,945,549 B2
(45) Date of Patent: Apr. 17, 2018

(54) PLUG FOR CONVERSION OF LAMPS WITH TWO NON-INTEGRATED 4-PIN CFL BULBS

(71) Applicants: Vladimir Sukhanov, Sunnyvale, CA (US); Sergiy Kuklenko, Sunnyvale, CA (US)

(72) Inventors: Vladimir Sukhanov, Sunnyvale, CA (US); Sergiy Kuklenko, Sunnyvale, CA (US)

( * ) Notice: Subject to any disclaimer, the term of this patent is extended or adjusted under 35 U.S.C. 154(b) by 0 days.

(21) Appl. No.: 15/351,149

(22) Filed: Nov. 14, 2016

(65) Prior Publication Data

US 2017/0370566 A1 Dec. 28, 2017

Related U.S. Application Data

(60) Provisional application No. 62/353,537, filed on Jun. 22, 2016.

(51) Int. Cl.

| | |
|---|---|
| ***H01R 31/00*** | (2006.01) |
| ***H01R 33/00*** | (2006.01) |
| ***F21V 23/06*** | (2006.01) |
| ***F21V 19/00*** | (2006.01) |
| ***H01R 33/08*** | (2006.01) |
| ***H01R 33/94*** | (2006.01) |
| ***H01R 43/28*** | (2006.01) |
| ***H01R 43/26*** | (2006.01) |
| *H01R 103/00* | (2006.01) |

(52) U.S. Cl.

CPC ..... *F21V 23/06* (2013.01); *F21V 19/0095* (2013.01); *H01R 33/08* (2013.01); *H01R 33/942* (2013.01); *H01R 43/26* (2013.01); *H01R 43/28* (2013.01); *H01R 2103/00* (2013.01)

(58) Field of Classification Search

CPC .... H01R 33/02; H01R 33/88; H01R 33/0818; H01R 33/948; H01R 33/94; H01R 24/54; H01R 25/00; H01R 31/06; H01R 31/88; H01R 31/94

USPC ..... 439/235, 227, 236, 300, 332, 628, 638, 439/640; 362/216, 221, 260

See application file for complete search history.

(56) References Cited

U.S. PATENT DOCUMENTS

| | | | | | |
|---|---|---|---|---|---|
| 4,971,567 | A * | 11/1990 | Mizuno | H04M 1/0293 | 439/441 |
| 5,378,958 | A * | 1/1995 | van Heeswijk | H01J 5/56 | 313/318.03 |
| 5,471,375 | A * | 11/1995 | Lau | F21S 8/02 | 362/216 |
| 5,746,615 | A * | 5/1998 | Ichikawa | F21V 19/0095 | 439/227 |
| 5,758,952 | A * | 6/1998 | Getselis | F21S 8/00 | 362/217.09 |
| 7,484,980 | B2 * | 2/2009 | Liao | F21V 19/0085 | 439/236 |
| 7,918,680 | B2 * | 4/2011 | Schapira | H01R 33/0809 | 439/338 |
| 2010/0253226 | A1 * | 10/2010 | Oki | F21V 3/00 | 315/113 |
| 2014/0340884 | A1 * | 11/2014 | Hsia | F21V 23/009 | 362/221 |
| 2017/0370566 | A1 * | 12/2017 | Sukhanov | F21V 23/06 | |

* cited by examiner

*Primary Examiner* — Chandrika Prasad
(74) *Attorney, Agent, or Firm* — Caleb St.-Jean

(57) ABSTRACT

This invention is a device and method for converting a non-integrated CFL lamp from a two-bulb configuration into a one-bulb configuration.

6 Claims, 6 Drawing Sheets

PLUG FOR CONVERSION OF LAMPS WITH TWO NON-INTEGRATED 4-PIN CFL BULBS

CROSS-REFERENCE TO RELATED APPLICATIONS

This patent application claims the benefit of U.S. provisional patent application No. 62/353,537, filed on Jun. 22, 2016, and priority is claimed thereto.

This patent application is referencing patents:

U.S. Pat. No. 5,471,375 issued to Kenneth Lau, "Fluorescent light ballast lamp mounting socket construction"

U.S. Pat. No. 5,746,615 issued to Masaaki Ichikawa, "Lighting device"

Which are hereby incorporated by reference in their entirety for the material disclosed therein.

BACKGROUND

The present invention relates to a device and method for supporting and maintaining of lighting solutions based on non-integrated CFL or LED non-integrated bulbs designed to work with universal electronic ballasts which can support one (single) or two (double) bulb configurations, depending on wiring.

Four-pin (4-pin) lamps are traditionally powered by electronic ballasts. The Electronic Universal CFL Ballast for 4-pin bulbs is suitable for bulbs with the base standards G24q and GX24q. The lamp base style is part of the ANSI NEMA specification. The G24q standard currently includes the bulb types: G24q-1, G24q-2, G24q-3, which have different power ratings, and in order not to mix them up they have small plastic guides which prevents using an incorrect bulb. A larger index in the type indicates larger power consumption and output, and requires using a more powerful ballast. The GX24q standard currently includes bulb types: GX24q-1, GX24q-2, GX24q-3, GX24q-4, and GX24q-5. The electrical schema for connecting bulbs to the ballast for all listed bulb types is substantially similar.

Many lighting solutions currently use two-bulb configurations of non-integrated CFL bulbs connected sequentially. When a failure occurs in one bulb in such a configuration, the entire light typically stops functioning, despite the second bulb still being in working order.

Modern LED bulbs also have advantages over CFL bulbs, such as greater energy efficiency and longer lifespan.

As can be seen, there is a need for a way to operate two-bulb CFL lights with only one bulb, as well as to replace CFL bulbs with LED bulbs. It would also be beneficial if the process were reversible and low-cost.

SUMMARY

In one aspect of the present invention, a device and method are described for a simple and cheap way of converting the two-bulb configuration of a tamp with non-integrated CFL bulbs into the single-bulb configuration. The device and method include a plug designed to substitute for one (and only one) bulb, while the other bulb either remains a non-integrated CFL bulb or is replaced with an LED bulb designed to work with the ballast as a non-integrated CFL bulb. The plug may be shaped to support different types of non-integrated bases having 4 pins.

These and other features, aspects, and advantages of the present invention will become better understood with reference to the following drawings, description, and claims.

DETAILED DESCRIPTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Broadly, an embodiment of the present invention allows a lamp having 4-pin non-integrated CFL bulbs in a two-bulb configuration to be used in a one-bulb configuration.

Figure 1:
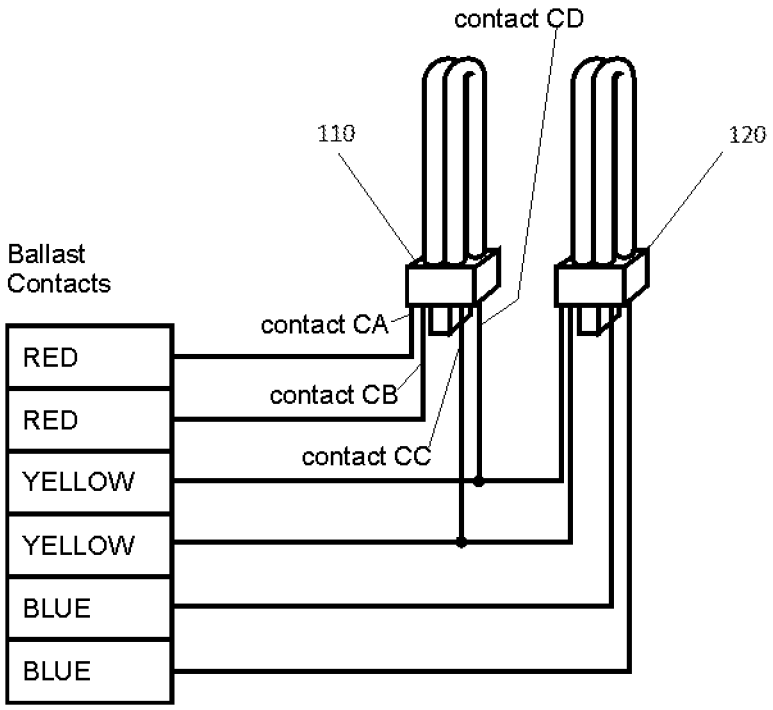
FIG. 1 is a diagram illustrating a typical two-bulb configuration of a light.

FIG. 1 is a typical wiring diagram illustrating a two-bulb configuration of a lamp. Each of Bulb 110 and Bulb 120 has 4 pins which are shown on FIG. 1 as "Contact CA", "Contact CB", "Contact CC", and "Contact CD". It is possible to convert this double bulb lamp into a single bulb lamp by removing one of the bulbs from the lamp socket and substituting it with a special plug which is the subject of this invention as shown on FIG. 3.

Figure 2:
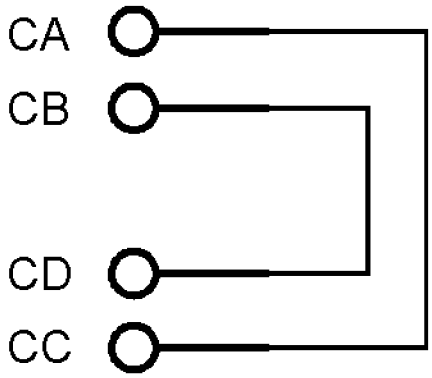
FIG. 2 is a schematic illustrating an embodiment of the plug device.

FIG. 2 is a schematic illustrating the wiring configuration of an embodiment of the plug device. Contact CA is electrically connected to Contact CC via copper wire or a similarly conductive material. Contact CB is electrically connected to Contact CD via copper wire or a similarly conductive material. The Plug is designed to substitute one (and only one) bulb while the other bulb should be either a non-integrated CFL 4 pin bulb or a LED bulb designed to work with electronic ballasts directly as a non-integrated CFL 4-pin bulb.

Figure 3:
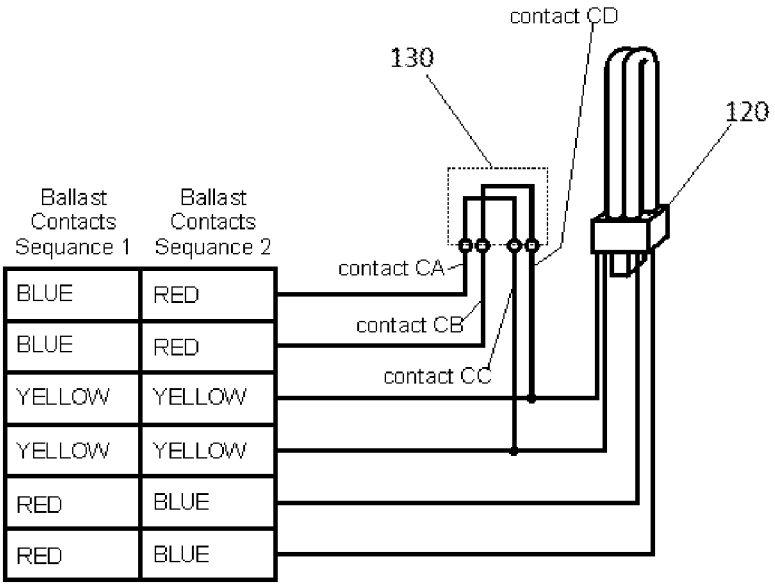
FIG. 3 is a illustrating an embodiment of the plug device in use.

FIG. 3 is a typical wiring diagram illustrating a two-bulb configuration of a lamp with an embodiment of the plug device 130 substituting for one of the bulbs. Contact CA is electrically connected to the lamp ballast via copper wire or a similarly conductive material. Contact CB is electrically connected to the lamp ballast via copper wire or a similarly conductive material. Contact CC is electrically connected to the lamp ballast and to one of the contacts of Bulb 120 via copper wire or a similarly conductive material. Contact CD is electrically connected to the lamp ballast and to one of the contacts of Bulb 120 via copper wire or a similarly conductive material. The key of the invention is the electrical schematic shown in FIG. 2 and FIG. 3. The mechanical implementation could be different and depends upon the base-type used in a particular non-integrated CFL or LED bulbs supported by the particular electronic ballast.

Figure 4:
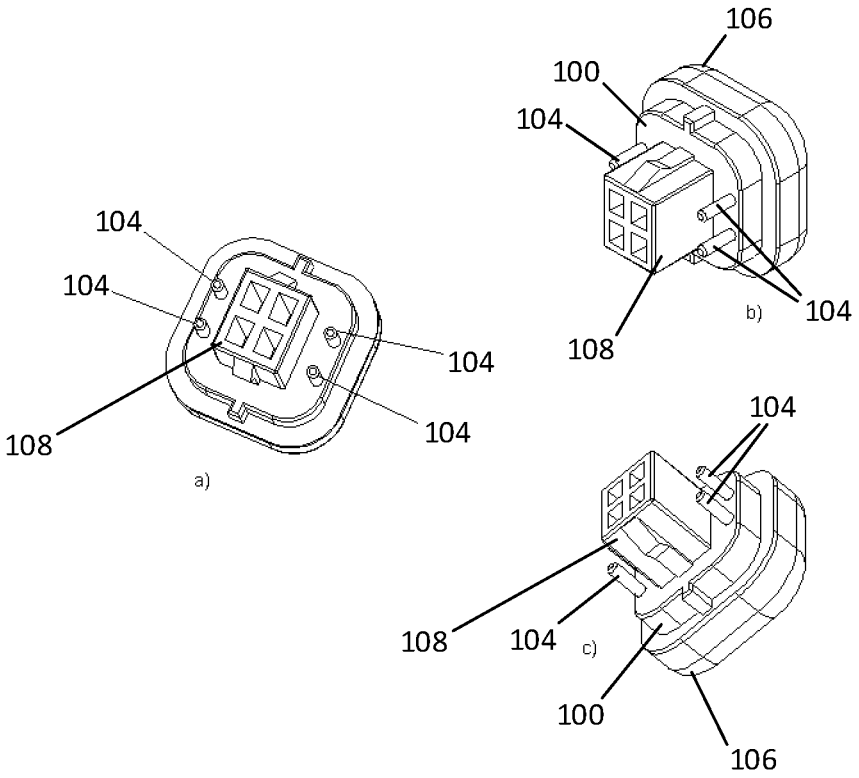
FIG. 4 is several isometric views of an embodiment of the plug device designed to fit the G24q CFL base.
Figure 5:
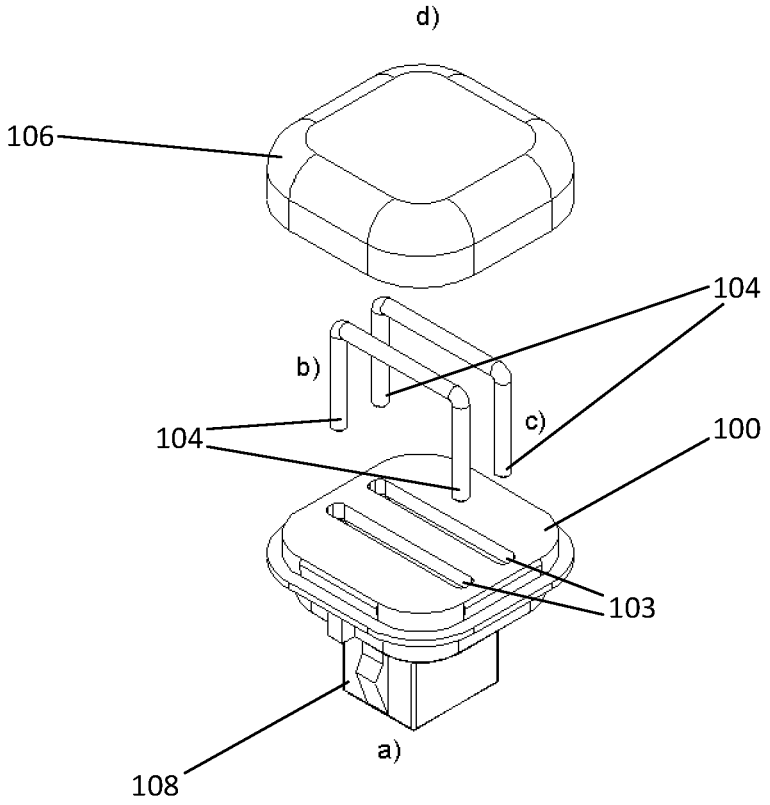
FIG. 5 is an exploded assembly of an embodiment of the plug device designed to fit the G24q CFL base.
Figure 6:
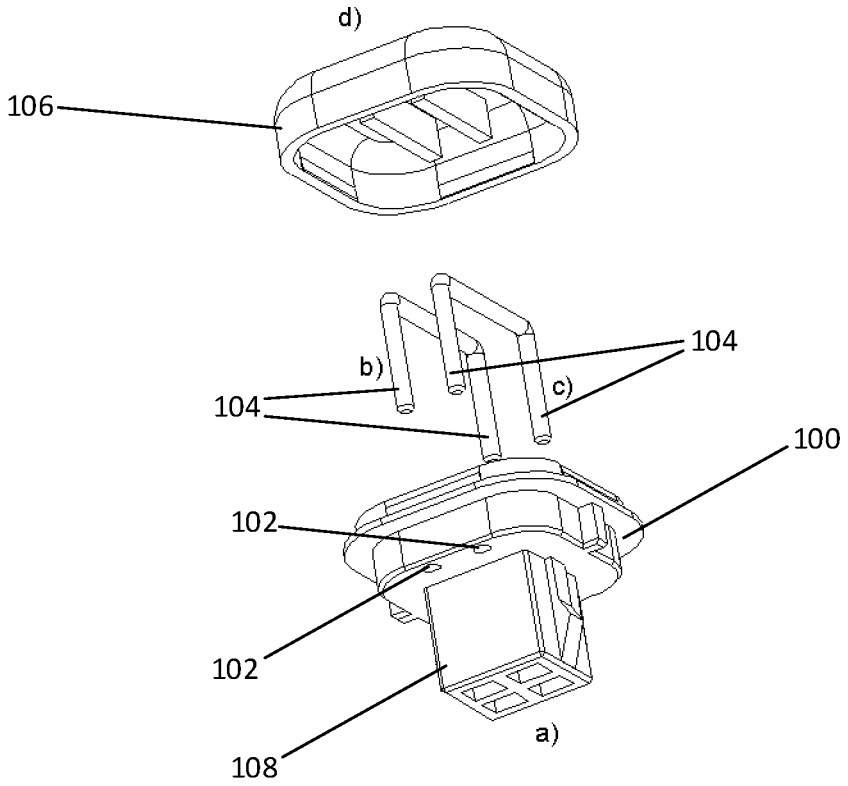
FIG. 6 is an alternate angle of an exploded assembly of an embodiment of the plug device designed to fit the G24q CFL base.

FIG. 4 illustrates an example embodiment of the plug device designed to substitute for a G24q-1 type bulb. Housing 100 is constructed of a substantially rigid and non-conductive material and is shaped to interface with a lamp socket. Base 108 as illustrated is shaped and designed to interface with G24q lamp socket. The G24q lamp socket interface is well-known in the art and is not described further here. Pins 104 are electrically interconnected pins. The shape and structure of pins 104 are illustrated further in FIGS. 5 and 6. Here, pins 104 are U-shaped bent pieces of electrically conductive wire. Pins 104 are inserted into holes 102. Holes 102 are illustrated in FIGS. 5 and 6. Holes 102 are pairs of holes with a cavity 103 between each pair of holes that are shaped and sized to receive pins 104. Cap 106 is a protective cap constructed of a substantially rigid and non-conductive material which covers housing 100 on the side where said pins 104 are interconnecting. Alternately, cap 106 is a protective layer of non-conductive compound coating which covers housing 100 on the side where pins 104 are interconnecting. Cap 106 is illustrated further in FIGS. 5 and 6.

Although the device and method have been described above using various specific details, one of ordinary skill in the art will recognize that the invention may be implemented in various different ways without departing from the spirit of the invention. For instance, various configurations of the device may be used, separately and/or conjunctively, to implement the method described above for different configurations or specifications of lamps. Also, the plug device may be designed to substitute for alternate bulb types apart from G24q-1.

It should be understood that the foregoing relates to exemplary embodiments of the invention and that modifications may be made without departing from the spirit and scope of the invention as set forth in the following claims.

What is claimed is:

1. A plug for conversion of lamps with two non-integrated 4-pin CFL bulbs comprising:

a housing constructed of a substantially rigid and non-conductive material shaped to interface with a lamp socket; and a first pair of holes in said housing, with a cavity between said first pair of holes; and a second pair of holes in said housing, with a cavity between said second pair of holes; and a first pair of electrically interconnected pins, with said pins being inserted in said first pair of holes of said housing; and a second pair of electrically interconnected pins, with said pins being inserted in said second pair of holes of said housing; and a protective cap constructed of a substantially rigid and non-conductive material which covers said housing on the side where said pin pairs are interconnecting, or a protective layer of non-conductive compound coating which covers said housing on the side where said pin pairs are interconnecting.

2. The plug of claim 1 where said first pair of electrically interconnected pins and second pair of electrically interconnected pins are shaped as two U-shaped bent pieces of electrically conductive wire.

3. The plug of claim 1 where said first pair of electrically interconnected pins and second pair of electrically interconnected pins are shaped as a U-shaped bent sheet metal.

4. The plug of claim 1 where said first pair of electrically interconnected pins and second pair of electrically interconnected pins are composed of a pair of 4 separate pins interconnected by two pieces of wire.

5. The plug of claim 1 where said housing is shaped to interface with a G24q lamp base.

6. The plug of claim 1 where said housing is shaped to interface with a GX24q lamp base.

* * * * *